US005169068A

United States Patent [19]

Bertolini

[11] Patent Number: 5,169,068

[45] Date of Patent: Dec. 8, 1992

[54] HAND-HELD JET WASHER

[76] Inventor: Franca Bertolini, Via Allende, 2/A, 42040 Sant'Ilario d'Enza - Reggio Emilia, Italy

[21] Appl. No.: 657,686

[22] Filed: Feb. 19, 1991

[30] Foreign Application Priority Data

Feb. 22, 1990 [IT] Italy ..... 46812 A/90

[51] Int. Cl.[5] ..... B05B 7/30; B05B 9/08

[52] U.S. Cl. ..... 239/154; 239/526

[58] Field of Search ..... 417/317; 239/124, 332, 239/525, 526, 532, 152

[56] References Cited

U.S. PATENT DOCUMENTS

| | | | |
|---|---|---|---|
| 1,964,281 | 6/1934 | Young et al. | 417/317 |
| 2,365,293 | 12/1958 | Laing | 417/234 X |
| 3,118,610 | 1/1964 | Techler | 239/526 X |
| 3,361,300 | 1/1968 | Kaplan | 239/310 X |
| 3,473,480 | 10/1969 | Kollmai | 417/234 X |
| 3,567,120 | 3/1971 | Suda | 239/8 |
| 3,578,884 | 5/1971 | Jacobson | 417/317 |
| 3,700,174 | 10/1972 | Beck | 239/532 X |
| 3,885,739 | 5/1975 | Tuttle | 239/124 |
| 3,901,449 | 8/1975 | Bochmann | 239/332 |
| 3,993,250 | 11/1976 | Shure | 239/332 |
| 4,114,812 | 9/1978 | Austin et al. | 239/532 X |
| 4,693,423 | 9/1987 | Roe et al. | 239/332 |
| 4,801,088 | 1/1978 | Baker | 239/332 X |
| 4,810,169 | 3/1989 | Kranzle | 239/152 X |
| 5,040,950 | 8/1991 | Dalquist et al. | 417/234 |

FOREIGN PATENT DOCUMENTS

| | | | |
|---|---|---|---|
| 7806012 | 12/1978 | Netherlands | 239/525 |

*Primary Examiner*—Andres Kashnikow
*Assistant Examiner*—Kevin P. Weldon
*Attorney, Agent, or Firm*—Steinberg & Raskin

[57] ABSTRACT

A jet washer for producing a high-pressure water jet includes an electric motor (10), a motor reduction gear (14) and a pump (12) formed as a single assembly with a lance (30), this single assembly being hand-holdable by the user. To enable it to be easily held, the jet washer is provided with handles or grips (16, 18) and possibly with a shoulder strap to enable it to be carried on the shoulders of the user. A device can be provided for mixing water with detergent taken from a suitable container (38) provided on the body of the jet washer.

14 Claims, 1 Drawing Sheet

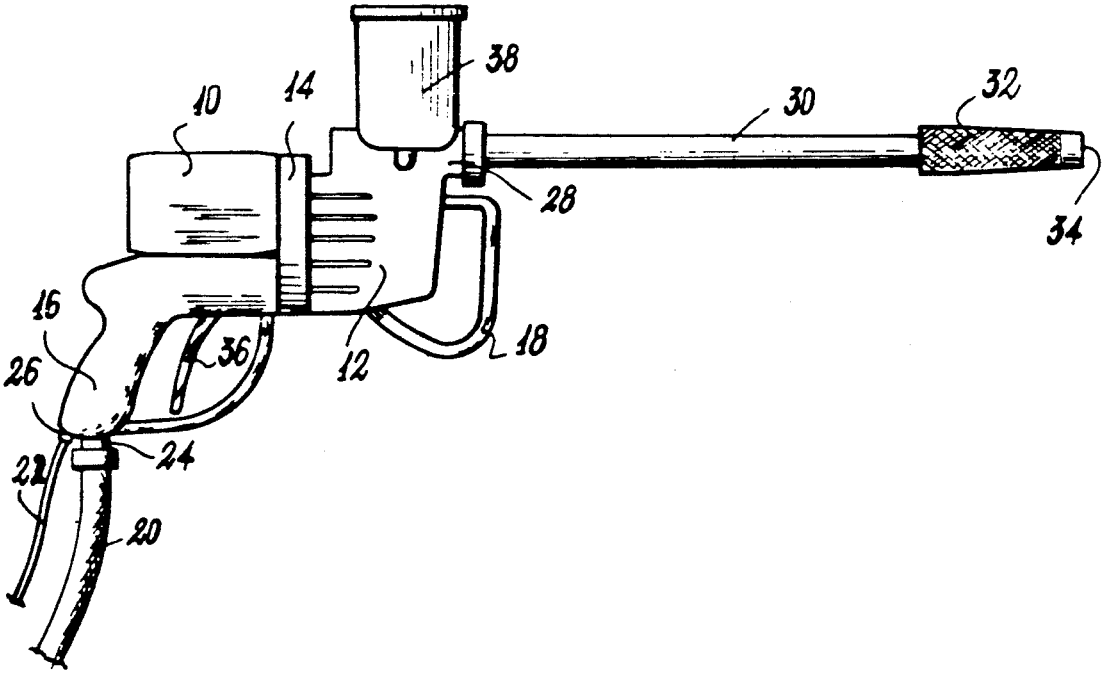
38
10
14
30
32
28
34
16
36
12
18
26
24
22
20

HAND-HELD JET WASHER

This invention relates to jet washers, and in particular to jet washers of non-professional or hobby type.

These latter are simple, relatively inexpensive known appliances of small overall size for producing a high pressure water jet, possibly mixed with detergent. The jet is directed towards the object to be washed via a lance.

Known jet washers of this type comprise a structure which rests on the ground and consists essentially of an electric motor, a pump and a reduction gear for reducing the speed of the pump drive motor.

The jet washer structure can be provided with wheels to facilitate its movement.

When the motor is operated, the pump draws water from the mains or from a water tank through a suitable hose.

Water leaves the pump at the desired pressure and is fed through a suitable hose (normally about 8 meters long) to a lance which is held by the user. A suitable device is also generally provided for mixing the water with an appropriate quantity of detergent contained in a container forming part of said jet washer structure.

When such jet washers are used, the electric motor once started remains continuously in operation until washing is finished, even while the jet is temporarily interrupted by the operator for various reasons, for example to change the washing position or to check the result of the wash.

For this reason the pump is provided with a bypass to prevent water hammer occurring which could damage the appliance.

As is apparent, the pressure drop along the high pressure hose extending from the jet washer structure to the lance, and normally 8 meters long, is considerable. This means that the electric motor has to be oversized to compensate for this pressure drop.

The object of the present invention is to provide a non-professional jet washer which compared with known jet washers is of lower construction and operating cost, is more manageable and is of smaller overall size.

Said object is attained by the non-professional jet washer according to the present invention, which is characterised in that the unit comprising the electric motor, the motor reduction gear and the pump form a single assembly with the lance, this single assembly being hand-holdable by the user.

As a result, the pressure drop between the jet washer structure and the lance is eliminated because of the elimination of the relative connection hose. This enables the electric motor power to be substantially reduced, resulting in a substantial energy saving and a reduction in the appliance cost.

To enable said single assembly, which is practice forms the jet washer, to be easily hand-held, it can be provided with suitable handles and/or handgrips.

In particular, the jet washer body can be provided with a rear handgrip, for example similar to a pistol handle, and a front handgrip, such as a knob or a stirrup, to enable the jet washer to be held in the manner of a gun.

The jet washer according to the invention can also be provided with a strap to enable it to be carried over the shoulders, so that not all of its weight acts on the user's arm.

The jet washer is conveniently operated by a control device of lever, trigger or pushbutton type, operable by one of the hands gripping one of the two said handgrips.

Conveniently, the control device operates both the electric motor and a valve which connects the pump to the water mains or to the water tank. Preferably, the electric motor is firstly started and then said valve opened, so that the motor attains a sufficient speed before water enters the pump.

In any event, even if the pump and electric motor are started simultaneously, it is not necessary to use a pump provided with a bypass in the jet washer according to the invention, as is necessary in known jet washers in which the electric motor is continuously in operation, with the danger of water hammer. This results in a simplified pump structure, with benefit both to its cost and weight.

In particular, to reduce the weight of the pump and thus obtain a hand-holdable jet washer of low weight, the pump casing can be of light metals or their alloys, for example based on magnesium, a metal of low specific gravity.

For the same reason, the motor reduction gear preferably comprises plastic gearwheels, with only the pinion on the electric motor shaft being of steel.

As in the case of known jet washers, the jet washer of the present invention can be provided with a device for mixing the water with a detergent taken from a suitable refillable container provided on the body of the jet washer.

The jet washer is connected to the water mains or to the water tank by a normal hose, and to the electricity mains or to another suitable electricity source by an electric cable.

Said cable and hose can also be combined to form a single linear element.

The fact that, as stated, the electric motor is of smaller power than electric motors of known non-professional jet washers and in addition the pump has a simpler structure than the pumps of known jet washers, and that several meters (usually 8 meters) of high pressure hose are eliminated (but are necessary in known jet washers) means that the resultant jet washer is much less costly than known types and consumes a smaller quantity of electricity.

The jet washer of the invention is also more simple, much more compact and less bulky than known jet washers because both the pump (simpler and of lower power) and the motor (of lower power) are smaller than the analogous devices of known jet washers. In addition, the elimination of said high pressure hose is also beneficial in terms of storage space requirements both before the sale and subsequently when the user stores the appliance after use. For this purpose the lance is conveniently made removable.

Overall, the jet washer obviously weighs more than the simple lance of a known non-professional jet washer. However its weight falls within manageable limits, especially if the aforesaid expedients are used to reduce its weight to a minimum. The fact of having a weight which could at first sight seem a defect of the jet washer according to the invention is in fact a merit. In this respect, the mass (of the motor, reduction gear and pump) acting on the lance improves its aiming stability and accuracy, the lance thus being less sensitive to the reaction (acting on it) produced by the issuing water jet. In any event the use of said strap reduces the weight acting on the user's arms to more acceptable limits.

The electricity source for powering the electric motor can also be a portable alternating current generator.

The electric motor can also be of direct current type, for example powered by a motor vehicle battery. In either case it is independent of the electricity mains.

The invention will be more apparent from the description of one embodiment thereof given hereinafter by way of example. In the description, reference is made to the accompanying drawing, in which the single FIGURE is a diagrammatic representation of the hand-held jet washer according to the invention.

It comprises a brush-type alternating current electric motor 10, or if a battery (such as a motor vehicle battery) is to be used as the electricity source a direct current motor. The motor drives a piston pump 12 (preferably of the type comprising three pistons arranged in a triangle) via a reduction gear 14 which steps down the speed of the motor shaft.

Conveniently the gearwheels of the reduction gear 14 are of plastics material to reduce its weight as much as possible.

For the same reason the pump casing is of light metal or alloy, such as magnesium.

The jet washer is provided with a first handgrip 16 in the shape of a piston handle and a second handgrip 18 in the shape of a stirrup. It is however obvious that the two handgrips can be of different shape and arrangement from those illustrated, provided they enable the jet washer to be securely and comfortably held. For this purpose, as already stated, the jet washer can be provided with a strap (not shown) for supporting it on the shoulders and thus allow it to be more easily used. By this means only part of the weight of the jet washer acts on the user's arms.

The jet washer must be supplied with both water and electrical energy. For this purpose a hose 20 is provided for feeding water taken from the water main or from a water tank or store (not shown). The end of the hose 20 is connected to an inlet connector 24 which in this specific case is provided at the bottom of the butt of the first handgrip 16. This connector leads to the inlet or suction of the pump 12 via an internal duct (not shown) within the handgrip 16.

An electric cable 22 for powering the motor 10 enters through a hole 26 provided in the bottom of the butt of the first handgrip 16. The cable is connected to the electricity mains, to an electricity generator or to a battery (if the motor is a direct current motor) as appropriate.

It is however apparent that both the connector 24 for connecting the water hose 20 and the hole 26 for the entry of the electric cable 22 can be arranged in positions other than those illustrated and described.

The pump exit or delivery 28 is located at the connector 28 to which the lance 30 is fitted. This latter can be provided with a manual low/high pressure regulator 32 of known type for adjusting the jet leaving the front nozzle 34 of the lance 30. This latter can be removed from the rest of the jet washer to reduce its overall size when stored. The hose 20 is also removable for the same reason.

In the illustrated embodiment the jet washer is operated by the trigger 36, which serves both to operate the electric motor and to open the valve (not shown) connecting the hose 20 to the suction side of the pump 12.

Preferably the trigger 36, when pressed, can assume two consecutive operating positions, namely a first position in which the electric motor 10 is activated and a second position in which said water valve is opened. The small period of time between the trigger attaining the first and second position when pressed is sufficient to allow the electric motor 10 to attain a speed which enables the jet washer to immediately operate with a sufficient water pressure as soon as the water valve is opened (second position).

The control device can be formed differently from that described. For example the electric motor control can be independent of the water valve control, the former being for example a simple switch and the latter a normal cock.

The jet washer is also provided with a container 38 of known type for the detergent. The container 38 is connected to the exit of the water from the pump, so that a certain quantity of detergent is mixed with this water, A valve (not shown) enables the detergent container 38 to be shut off so that washing can take place with water alone.

By way of example the electric motor can have an output power of about 1100 watts and the pump a capacity of 8 liters of water per minute at 80 bar.

From the aforegoing it is apparent that the hand-held jet washer according to the invention is extremely simple, compact and of small overall size, besides being extremely easy to use.

It also consumes substantially less energy than known non-professional jet washers, and finally is of considerably lower cost than these.

I claim:

1. (Twice amended) A non-professional jet washer, comprising:

a lance adapted to direct a washing fluid toward an object to be washed, said lance being made of a rigid material, a piston pump, said pump rigidly connected to said lance and supplying a stream of washing fluid under sufficiently high pressure to said lance to wash an object at which said lance is directed, means for providing a continuous flow of washing fluid to said pump, an electric motor, a motor reduction gear, said motor adapted to drive said pump via said motor reduction gear when said motor is activated, said electric motor and said motor reduction gear being rigidly attached to said pump as a hand-holdable, single assembly.

2. A jet washer as claimed in claim 1, characterised by comprising handles or handgrips (16, 18) to enable it to be easily hand-held.

3. A jet washer as claimed in claim 1, characterised by comprising a rear handgrip (16) similar to a piston handle, and a front handgrip (18), to enable the jet washer to be held in the manner of a gun.

4. A jet washer as claimed in claim 1, characterized by comprising a shoulder strap.

5. A jet washer as claimed in claim 1, characterised by comprising a control device (36) which both starts the electric motor (10) and opens a valve which connects the pump suction to water mains or to a water tank.

6. A jet washer as claimed in claim 5, characterised in that said control device (36) firstly starts the electric motor (10) and then opens the water valve.

7. A jet washer as claimed in claim 1, characterised in that the casing of the pump (12) is constructed of light metals or their alloys.

8. A jet washer as claimed in claim 1, characterised in that the pump comprises three pistons arranged in a triangle.

9. A jet washer as claimed in claim 1, characterised by comprising a device for mixing the water with detergent taken from a suitable refillable container (38) provided on said single assembly of the jet washer.

10. A jet washer as claimed in claim 1, characterised in that the electric motor (10) is of direct current type.

11. The jet washer of claim 1, further comprising a first handgrip attached to a lower rearward portion of said single assembly, and a second handgrip attached to a forwardmost portion of said single assembly, said first and second handgrips enabling the jet washer to be held by the user in a gun-like manner.

12. The jet washer of claim 11, wherein said first handgrip further comprises a trigger means, said trigger means adapted to be movable to a first position in which said electric motor is activated and a second position in which washing fluid is provided to said pump.

13. The jet washer of claim 11, wherein said first handgrip includes a butt portion having inlet means, further comprising a hose adapted to feed a washing fluid to said pump, and an electric cable connecting a source of electricity to said motor, said hose and said electric cable entering said butt portion of said first handgrip via said inlet means.

14. The jet washer of claim 13, wherein said lance and said hose are removable.

* * * * *